United States Patent [19]

Nützel et al.

[11] Patent Number: 4,648,146

[45] Date of Patent: Mar. 10, 1987

[54] APPARATUS FOR AND METHOD OF ASSEMBLING A TENSION TIE MEMBER

[75] Inventors: Oswald Nützel, Munich; Egbert Zimmermann, Oberaudorf, both of Fed. Rep. of Germany

[73] Assignee: Dyckerhoff & Widmann Aktiengesellschaft, Munich, Fed. Rep. of Germany

[21] Appl. No.: 728,757

[22] Filed: Apr. 30, 1985

[30] Foreign Application Priority Data

Oct. 10, 1984 [DE] Fed. Rep. of Germany ..... 3437108

[51] Int. Cl.[4] ..... E01D 11/00

[52] U.S. Cl. ..... 14/21; 14/23; 14/1; 52/223 R

[58] Field of Search ..... 14/18–23; 404/70; 52/223 L, 223 R, 230, 148, 151; 403/275; 254/29 A

[56] References Cited

U.S. PATENT DOCUMENTS

| | | | |
|---|---|---|---|
| 3,597,830 | 8/1971 | Yegge | 254/29 A X |
| 3,647,184 | 3/1972 | Vanderhurst et al. | 52/223 R |
| 4,473,915 | 10/1984 | Finsterwalder | 14/21 |

*Primary Examiner*—James A. Leppink
*Assistant Examiner*—Matthew Smith
*Attorney, Agent, or Firm*—Toren, McGeady and Goldberg

[57] ABSTRACT

In the assembly of a tension tie member between spaced anchors when the tie member is made up of a number of individual tension elements, such as steel wires, steel strands or the like, enclosed within a tubular sheathing, the tension elements are inserted individually and successively between the anchors and it is necessary to insert the annular wedges which anchor each element before the tension elements are released from a threading device. To prevent the annular wedges from prematurely entering into the boreholes in the anchor plate, an auxiliary plate is positioned spaced from the anchor plate. The auxiliary plate has at least one through borehole axially alignable with the boreholes in the anchor plate. A tubular section is secured to the auxiliary plate and forms an extension of the borehole therein. An annular wedge to be inserted into one of the boreholes and the anchor plate can be held on the tubular section by resiliently expanding the wedge about the outer surface of the tubular section. An individual tension element can be inserted through the auxiliary plate and then through the anchor plate and the tubular sheathing and finally through the other anchor plate without any interference from the annular wedge. After the tension element is completely inserted, the wedge can be slipped off the tubular section and inserted into the borehole in the anchor plate by means of a simple handle.

18 Claims, 17 Drawing Figures

APPARATUS FOR AND METHOD OF ASSEMBLING A TENSION TIE MEMBER

BACKGROUND OF THE INVENTION

The present invention is directed to an apparatus for assembling a tension tie member made up of individual tension elements, such as steel wires, strands and the like, and arranged within a tubular sheathing. The tension elements are inserted individually and successively through conically shaped boreholes in an anchor plate into the tubular sheathing and the tension elements are anchored in the plate by multi-part annular wedges. The invention is also directed to the method of assembling and anchoring a tension tie member in a structure, such as a diagonal cable in a stayed girder bridge.

Tension tie members, such as are used in civil engineering for anchoring different parts of a structure, such as diagonal cables in stayed girder bridges or the like, frequently are made up of a bundle of individual parallel tension elements, such as steel wires or strands, arranged together in the unsupported area of the tension tie member between the parts of the structure and enclosed within a tubular sheathing. The tension tie member is guided through the parts of the structure in a passageway or duct so that the tie member is longitudinally or axially movable and the opposite ends of the tie member are anchored on the outsides of the parts of the structure relative to the sides between which the tie member extends. Anchor members include an anchor plate with conically shaped boreholes through which the individual elements are inserted and in which they are anchored by multi-part annular wedges. The tubular sheathing can be formed in the unsupported region between the parts of the structure by a plastics material tube, such as a polyethylene tube, or a steel pipe. In the region of the anchorage usually a steel anchor tube is employed. The space within the tubular sheathing around the individual tension element is grouted after the elements are tensioned. Either an anti corrosive substance can be used in the grouting operation or a hardenable material, such as a cement mortar. A tension tie member of this type remains post-tensionable and replaceable after the grouting operation.

As is particularly the case in diagonal cables of stayed girder bridges, difficulties are involved in installing heavy cables in the required diagonal position between anchorages in the roadway girder and in the bridge tower, because of the great height involved. If the diagonal cables are assembled on a working plane, such as the roadway slab of a completed bridge section, then the cables must be lifted into the required diagonal position using lifting apparatus and simultaneously threading the tie member into the lower and upper anchorages. It is also possible to provide a diagonal template mounted on scaffolds for the installation of the diagonal cable and to thread the individual tension elements through the tubular sheathing and the anchor members while the cable is supported on the template. All of the individual tension elements are tensioned simultaneously in such an arrangement. To reduce the costs involved and to simplify the procedures for installing diagonal cables it has been known first to thread only one tension element into the tubular sheathing placed on a working plane and then to insert the tension element into the anchoring members already in place and to tension the element. In this procedure, the tubular sheathing is arranged in an inclined but straight position extending between the two anchor members, note West German Offenlegungsschrift No. 31 38 819. Subsequently, the rest of the individual tension elements are installed and anchored, in each instance, after tensioning.

When a diagonal cable is assembled in this manner it is difficult in the unsupported region of the cable to push the individual tension elements through the often very long tubular sheathing without having the elements become jammed in an inaccessible location. In the anchor region difficulties occur in placing, at first, the unordered position of the individual tension elements within the tubular sheathing to correspond with the arrangement in the anchor members, that is, threading the individual elements into the conically shaped boreholes in the anchor plate accompanied by the spreading of the elements. In a known method this problem was solved by providing ducts adjoining the anchor plate and extending over the length of the spreading region with the ducts being in the form of additional sheathing tubes with an opening provided in front of the ducts so that each individual tension element can be individually threaded into a duct so that it passes directly into the corresponding borehole in the anchor plate when it exits from the duct.

Another problem experienced in assembling diagonal cables along a diagonal path is that the work must be carried out against the force of gravity when the individual tension elements are inserted in an upward direction, that is, a greater expenditure force is required. When the individual tension elements are inserted in the downward direction, it is necessary to secure the individual elements against slipping after they are inserted and before they are cut off. The securement of the tension element is effected by wedges also required for the anchoring operation, however, it is necessary that the wedges are placed on the individual elements at the commencement of the insertion step and each element must be pushed through the corresponding wedge. This movement of the element through the wedge is not possible, since the individual sections of the annular wedges are provided with teeth on the interior for securing the elements and the teeth damage the surface of the elements when they are passing through them. Theoretically, the annular wedges made up of a plurality of sections, preferably three sections, are held together by a spring ring so that the wedge could be taken apart and installed from the side of the element, such an operation would require additional assemby manipulations.

SUMMARY OF THE INVENTION

Therefore, the primary object of the present invention is to facilitate and simplify the assembly of tension tie members of the type described above, particularly where the tension tie members are diagonal cables used in stayed girder bridges.

In accordance with the present invention, the apparatus for assembling the tension tie member includes an auxiliary plate positioned at a distance from the anchor plate with the auxiliary plate having at least one through-opening or borehole which can be aligned with the boreholes in the anchor disc. A tubular section is provided on the side of the auxiliary plate and is secured to it so that an annular wedge can be pushed over the outside surface of the tubular section due to the resilient expansion of the wedge.

Based on the invention it is possible to insert the individual tension elements through a multi-part annular wedge without any risk of damage to the surface of the tension element due to contact with the teeth on the inside surface of the wedge, particularly where the surface is made up of strands. Further, this arrangement prevents the wedge from being prematurely displaced into the conical borehole in the anchor plate and thereby blocking the movement of the element. In the present invention, each wedge, spread by means of a mandrel is placed on the tubular section aligned with the opening or passage through the auxiliary plate with the auxiliary plate located opposite the anchor disc before the individual tension elements are inserted. To meet the exacting tolerances involved, the tubular section is preferably formed of a precision steel tube. Accordingly, the individual elements can be inserted through the wedge without any interference and, after the insertion step is completed, the wedge can be displaced from the tubular section into the seat or borehole in the anchor plate by means of a simple handle. Accordingly, the individual tension elements can be secured and cut off without the tension elements sliding downwardly.

The auxiliary plate can be provided with a number of through-openings or boreholes corresponding to the number of boreholes in the anchor plate so that the openings and the boreholes can be axially aligned. Alternatively, the auxiliary plate can be provided with a disc rotatable about the axis of the tension tie member so that openings through the disc can be successively aligned with the boreholes in the anchor plate. If the anchor plate contains boreholes arranged in concentric circles, each opening in the rotatable disc can be positioned so that it aligns with one of the circles.

Another disc is also possible having a single opening therethrough where the disc is eccentrically positioned in the auxiliary plate.

Furthermore, it is possible to arrange a connecting tubular section on the outside of the disc which forms a continuation of the opening through the disc. Since the disc including the securely coupled threading tube is freely rotatable, it aligns itself automatically, so that unintended transverse stresses on the individual tension elements are prevented.

To facilitate the insertion of the individual tension elements into and through the tubular sheathing, it is preferable to place a threading tip on the leading end of the element with the threading tip having an approximately oval shape. Since the threaded tip can be positioned on the individual tension element only after it is passed through the anchor plate, during assembly the anchor plate must be spaced a distance from the abutment plate against which it seats in the final anchored position. This displacement is achieved in a simple manner, according to the present invention, by providing an additional or auxiliary plate spaced outwardly from the anchor disc with the auxiliary plate providing an intermediate anchoring plate with conically shaped boreholes corresponding to the conically shaped boreholes in the anchor plate. Tubular sections are provided for each of the boreholes through the auxiliary plate on which the corresponding wedges can be held while the tension elements are being inserted so that the wedges do not engage the outside surface of the elements.

Preferably, the auxiliary anchor plate is supported from an abutment plate by laterally arranged supports.

On the side of the auxiliary anchor plate facing toward the main anchor plate, a wedge disc can be mounted having a number of boreholes therethrough corresponding to the number of tubular sections on the auxiliary anchor plate and the disc can be moved over the tubular section so that it can be moved in the axial or longitudinal direction of the tension tie member.

The lateral supports for the auxiliary anchor plate are preferably supported on the abutment plate so that they are displaceable under load and may be formed in part by hydraulic presses. A holding member for the anchor plate can be located on the supports and preferably the holding member is supported at the supports so that it can be moved and fixed relative to the supports.

The advantage of this arrangement is that the anchor plate is fully accessible on both sides during the insertion of the individual tension elements and can be displaced into the final anchor position in a simple manner. After inserting the wedges into the corresponding boreholes in the anchor plate which movement can be effected by the wedge disc associated with the auxiliary anchor plate, the load supported on the auxiliary anchor plate due to the tensioning of the individual tension elements against this plate is transferred to the main anchor plate by moving the auxiliary anchor plate by means of the hydraulic presses. To insert the wedges in the auxiliary anchor plate it is preferable to provide a rotatable disc with at least one through-opening provided with a corresponding tubular section in spaced relation from the auxiliary anchor plate on the opposite side thereof from the main anchor plate.

In the method of assembling and installing a diagonal cable using the apparatus discussed above, the individual elements are individually and successively inserted and at least partially tensioned and anchored in the auxiliary anchor plate. The main anchor plate is spaced from its final anchor position and also from the auxiliary anchor plate. After all of the individual tension elements are inserted, the main anchor plate is moved into its final anchor position and the individual tension elements are anchored to it. Finally, the tension load on the tension tie member is transferred from the auxiliary anchor plate to the main anchor plate, note FIG. 2.

To assemble and install an inclined tension tie member, after positioning and fixing the tubular sheathing, some of the individual tension elements located in the upper part of the cable are inserted through the anchors and are tensioned and secured. After the initial insertion, the remaining individual tension elements located below the inserted elements in the tension tie member are inserted successively in the upward direction. It is preferable if the first inserted tension elements are lifted somewhat at the location where the tension tie member exits from the structure, note FIG. 13.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
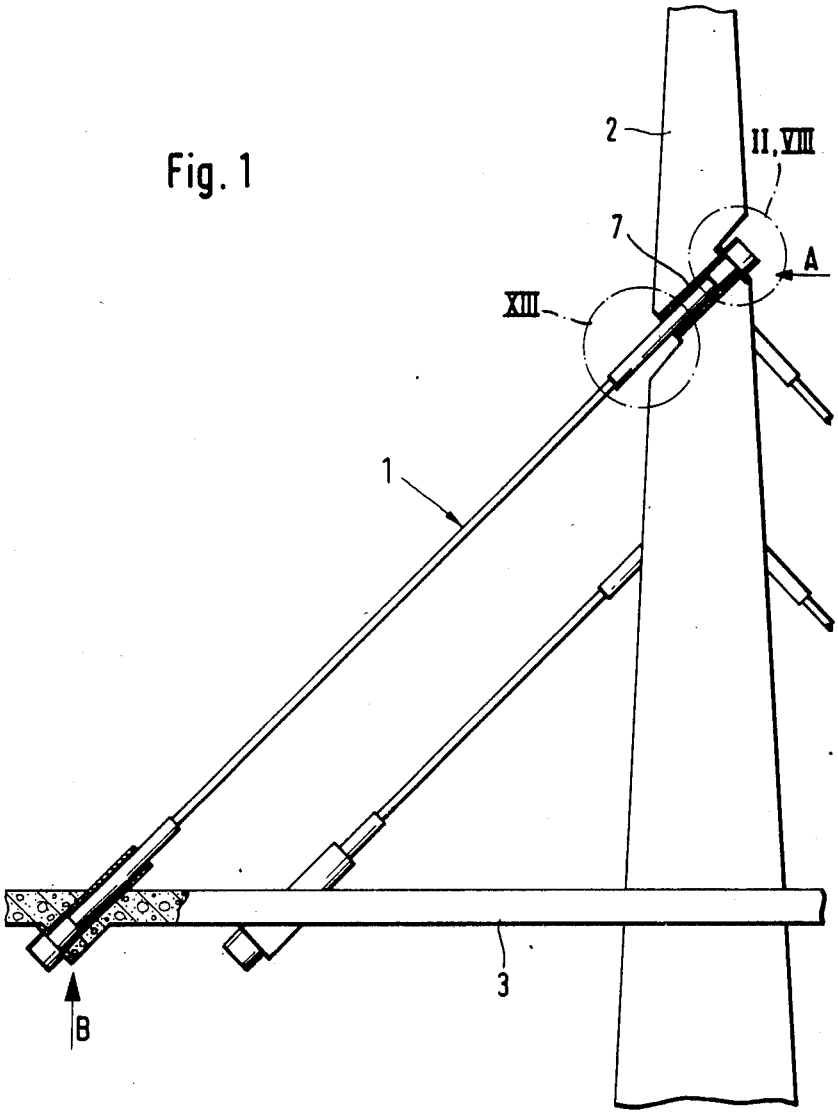
FIG. 1 is a schematic side view, partly in section, of a stayed girder bridge with diagonal cables.

The invention is shown in the drawing as one of several diagonal cables 1 in a stayed girder bridge. FIG. 1 is a schematic elevational view of a stayed girder bridge with a tower 2 of reinforced concrete extending upwardly above a roadway girder 3 also formed of reinforced concrete or prestressed concrete. The invention is not limited to stayed girder bridges or to the specific materials used in forming the tower and the roadway girder.

In FIG. 1, diagonal cable 1 passes downwardly through the tower 2 and the roadway girder 3. In both parts of the bridge the cable 1 passes through a duct or passageway so that it is longitudinally movable. Anchor A securing the diagonal cable to the tower 2 is located on the opposite side of the tower from the side where the cable extends downwardly to the roadway girder 3. The anchor B for securing the lower end of the diagonal cable is located on the lower side of the roadway girder.

Figure 8:
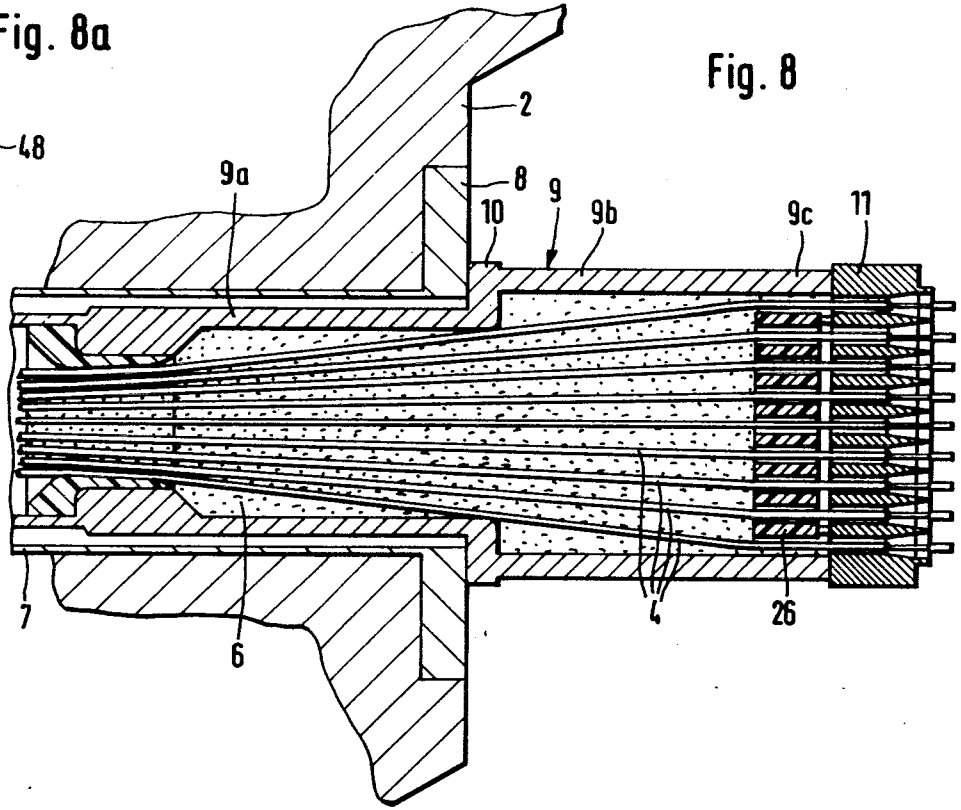
FIG. 8 is a longitudinal section through the anchor arrangement shown in FIG. 2, illustrated in the final anchor condition.
Figure 8A:
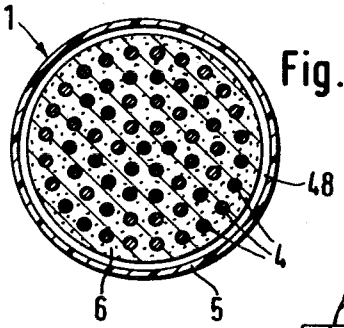
FIG. 8*a* is a cross-sectional view through the diagonal cable in the unsupported region of the cable between the anchors.

Diagonal cable 1 is made up of a bundle of individual tension elements 4, in the present instance the tension elements are made up of steel strands located within a tubular sheathing 5, note FIG. 8*a*. The space within the tubular sheathing 5 around the tension elements 4 is filled with a hardenable material 6, such as a cement mortar. The tubular sheathing extending unsupported between the tower and the roadway girder is formed of a plastics material tube or of a steel tube. Preferably, a steel tube forms the sheathing in the region of the anchors A and B where the diagonal cable is guided through a part of the bridge structure.

The assembly of such a diagonal cable will be explained in more detail as follows with the aid of FIGS. 2 to 8 and, by way of example, describing the anchor A at the tower 2.

Figures 2, 2A, 2B:
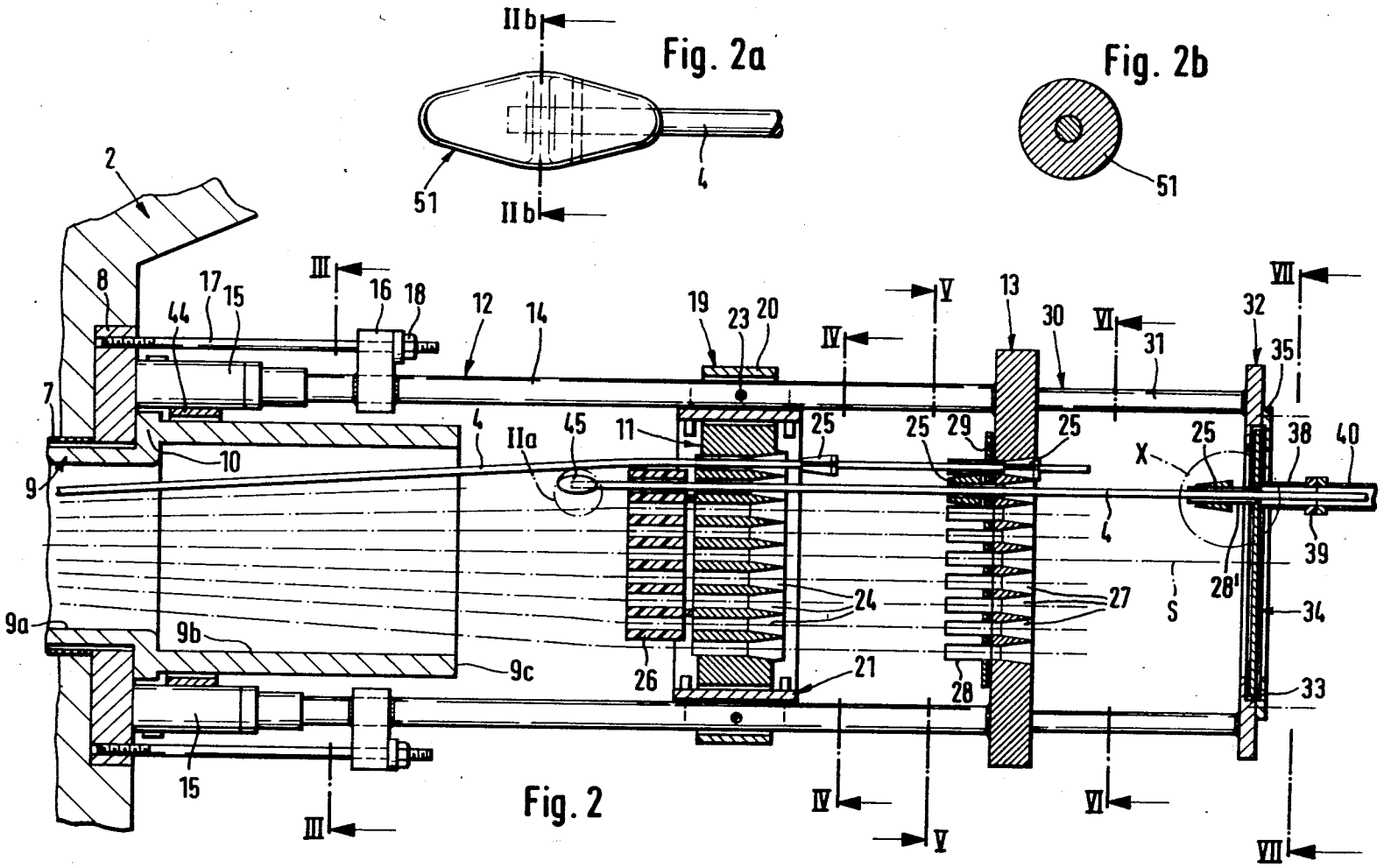
FIG. 2 is a sectional view of detail II in FIG. 1 illustrating an apparatus for anchoring a diagonal cable, according to the present invention, during the assembly of the cable and shown in axially extending section.
FIG. 2*a* is a side view on an enlarged scale of detail IIa in FIG. 2.
FIG. 2*b* is a sectional view taken along the line II-b—IIb in FIG. 2*a;*

As shown in the axially extending sectional view of FIG. 2 a steel tube 7 forms a passageway or duct through the tower 2 for receiving the diagonal cable 1. The tube 7 is embedded in the concrete forming the tower. At one end the tube is secured to an abutment plate 8 located on the side of the tower 2 at which the anchor A is located. A steel anchor tube 9 is located within the tube 7 and projects outwardly from the side of the tower on which the anchor A is located. The tube 9 has a flange-like section 10 in contact with the abutment plate 8. An inner part 9*a* of the tube is located within the tube 7 and it has a smaller diameter than the outer part 9*b* which projects outwardly from the flange-like section 10. In the final state of the anchor, an anchor disc or plate 11 is supported against the outer end 9*c* of the anchor tube, note FIG. 8. As mentioned above, the flange-like section 10 of the anchor tube 9 bears against the abutment plate 8. This arrangement of the anchor for the diagonal cable is advantageous with regard to the fatigue strength of the anchor, but is not an essential part of the invention. It would be possible to support the anchor disc 11 directly on the abutment plate 8.

For assembling the diagonal cable and its anchor, a support arrangement 12 is provided including an auxiliary plate 13 which is supported against and extends axially outwardly from the abutment plate 8. Support arrangement 12 includes a number of steel supports 14 arranged symmetrically about the axis of the diagonal cable. The supports 14 are securely connected to the auxiliary anchor plate 13, such as by welding, and the supports bear against the abutment 8. The support of the supports 14 on the abutment plate 8 is effected by hydraulic presses 15 which form a continuation of the supports. To hold the support construction in the position illustrated, brackets 16 are attached to and project outwardly from the supports relative to the diagonal cable. Bolts 17 are threaded into the abutment plate and extend through boreholes in the brackets 16. Nuts 18 on the bolts 17 secure the support arrangement 12 on the abutment plate 8, note FIG. 2.

Figure 4:
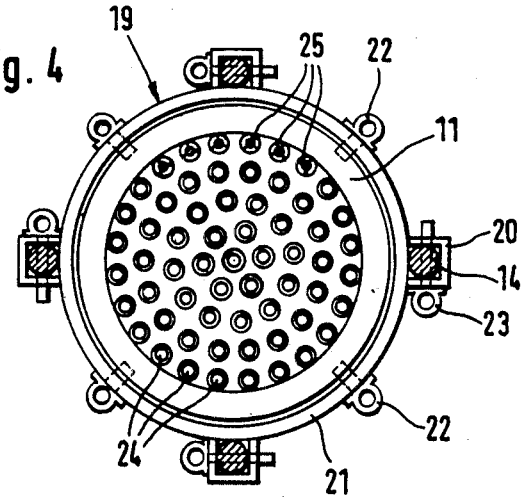
FIG. 4 is a sectional view taken along the line IV—IV in FIG. 2.

The support arrangement includes a holding device 19 for positioning the main anchor plate 11 on the supports 14 so that the plate is movable in the axial direction of the supports, note FIG. 4. The holding device 19 has guide bushings 20 on each of the supports 14 and a holding ring 21 has attached bushings and laterally surrounds the main anchor plate 11 inwardly of the bushings, that is, the ring 21 extends around the outer circumference of the plate 11. Securing pins 22 fix the anchor disc 11 to the holding ring 21 and the guide bushings can be fixed to the supports by securing pins 23.

As can be seen in FIG. 2, the main anchor disc 11 has a plurality of boreholes therethrough with each borehole having an axially extending conically shaped section more remote from the tube 9 and a cylindrically shaped section at the smaller end of the conically shaped section and closer to the tube 9. Each conically shaped section serves as a seat for an annlar wedge 25 which anchors the corresponding tension element in the main anchor plate. On the side of the main anchor plate 11 closer to the tube 9, a plastics material spacer ring 26 is provided for deflecting the tension elements 4, which have been spread apart toward the anchor, back into the parallel relation with the spacer ring absorbing the radially inwardly directed deflecting forces which develop. Spacer ring 26 can be connected with the main anchor plate 11 as a unit for facilitating installation.

Figure 5:
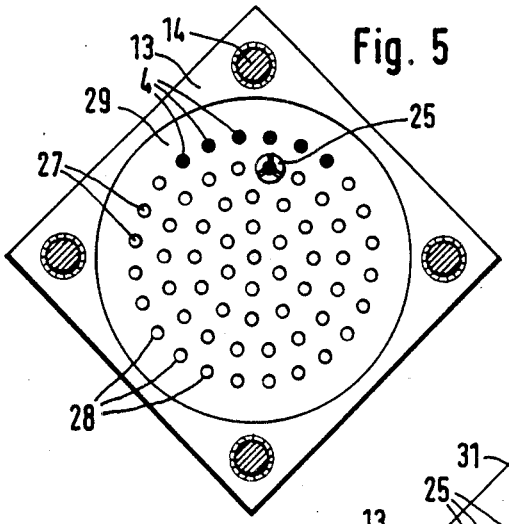
FIG. 5 is a sectional view taken along the line V—V in FIG. 2.
Figure 6:
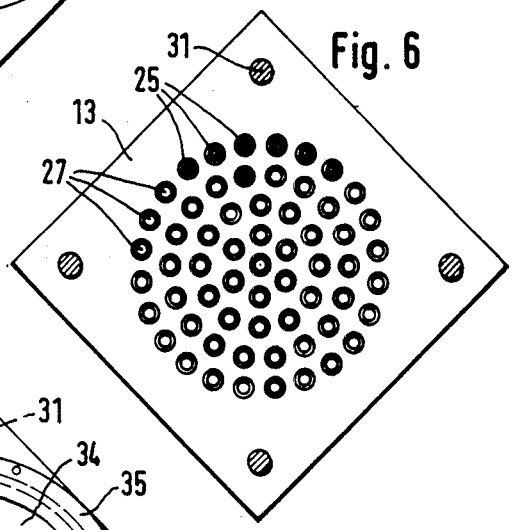
FIG. 6 is a sectional view taken along the line VI—VI in FIG. 2.

In FIG. 5 the side of the auxiliary anchor plate 13 closer to the main anchor plate 11 is shown while FIG. 6 illustrates the opposite side of the auxiliary plate. Auxiliary anchor plate 13 contains a number of boreholes corresponding in number and arrangement to the boreholes in the anchor disc 11. The tension elements or strands 4 can be anchored intermediately by the annular wedges 25 within the auxiliary anchor plate 13. Boreholes 27 in the auxiliary anchor plate 13 are similar to the boreholes 24 in the main anchor plate 11 having a conically shaped section, forming a seat, for the wedges and an adjoining cylindricially shaped section. At the surface of the plate 13 at the ends of the cylindrically shaped sections, tubular sections 28 project axially outwardly from the plate. On the side of the auxiliary anchor plate 13 closer to the main anchor plate 11 there is a wedge disc or plate 29 having openings therethrough with a somewhat larger diameter corresponding to the outside diameter of the tubular sections 28 so that the disc can be displaced over the tubular sections. Wedge disc or plate 29 is displaceable within the supports 14 between the auxiliary anchor plate 13 and the main anchor plate 11 by actuating means, not shown.

Figure 7:
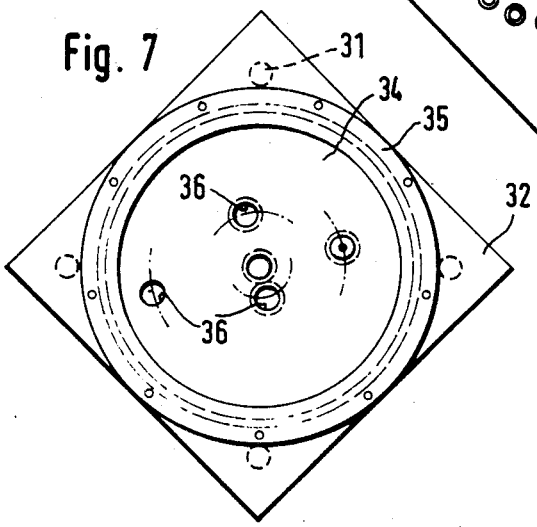
FIG. 7 is a sectional view taken along the line VII—VII in FIG. 2.
Figure 10:
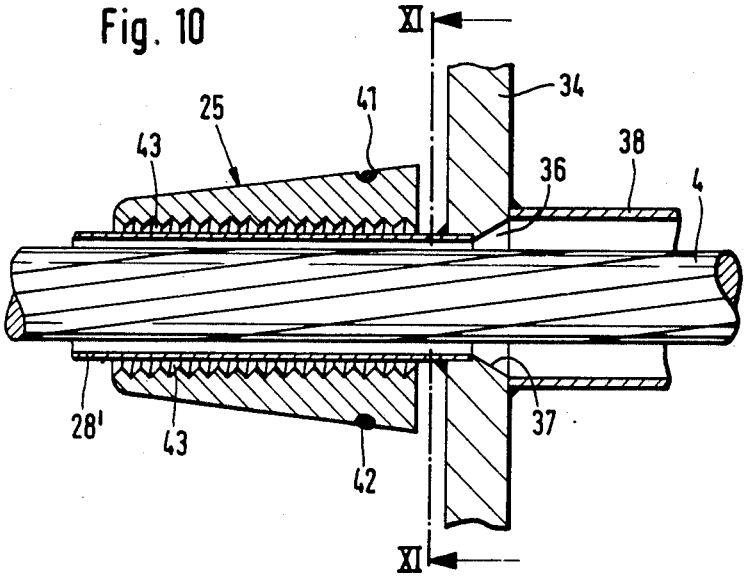
FIG. 10. is a sectional view on an enlarged scale of detail X in FIG. 2.

Another support arrangement 30 for a threading disc 34 which facilitates the threading of the tension elements or strands 4 is spaced outwardly from the auxiliary anchor plate 13, note FIG. 7. The support arrangement 30 has a number of supports 31 corresponding to the supports 14 and a bearing plate 32 is supported on the ends of the supports 31 spaced from the auxiliary anchor plate 13. Bearing plate 32 has a recess 33 containing a circular threading disc 34 so that the disc 34 is rotatable about the central axis of the cable 1 and is secured in place by a circular holding ring 35 screwed onto the bearing plate 32. Threading disc 34 has a number of openings 36 extending therethrough each of which is assigned to one of the boreholes 27 arranged in concentric circles in the auxiliary anchor plate 13, note FIG. 6. An axial section through one of the openings 36 in the disc 34 is shown on an enlarged scale in FIG. 10 which illustrates the detail X in FIG. 2.

On the side of the disc 34 closer to the auxiliary anchor plate 13, a tubular section 28' forms a continuation of the opening 36. On the opposite side of the disc 34 a connecting tube 38 projects outwardly and is connected by a coupling 39 to a threading tube 40. Tube 38 is welded to the threading disc 34 around the entrance to the opening 36 formed by a frustoconical section 37, see FIG. 10. Accordingly, each of the openings 36 can be successively aligned with one of the boreholes 27 in the auxiliary anchor plate 13 located on a circle corresponding to the opening by rotating the disc 34 in the bearing plate 32, note FIG. 7.

Figure 9:
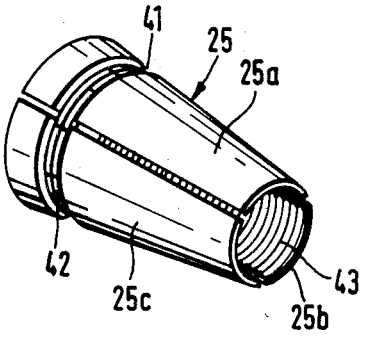
FIG. 9 is a perspective view of a multi-part annular wedge used for anchoring individual tension elements.
Figure 11:
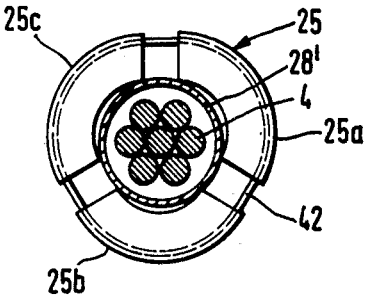
FIG. 11 is a sectional view taken along line XI—XI in FIG. 10.
Figure 12:
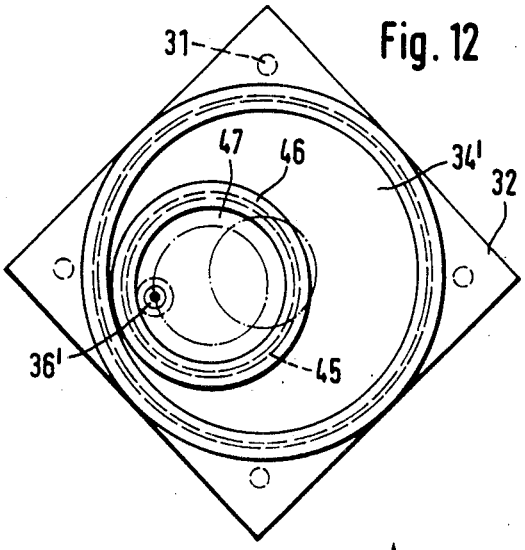
FIG. 12 is an elevational view of another embodiment of a threading disc corresponding to line VII—VII in FIG. 2.

Another embodiment of such a threading disc is displayed in FIG. 12 which illustrates a section along line VII—VII in FIG. 2 corresponding to FIG. 7. Threading disc 34' is located in a circular recess in bearing plate 32 and in turn has an eccentric circular recess 45 in which an eccentric disc 47 is rotatably mounted. Eccentric disc 47 is held in the recess by a circular holding ring 46. Eccentric disc 47 is arranged eccentrically relative to the central axis of the cable. A single opening 36' is formed through the disc 47. By rotating the disc 47 and the threading disc 34', the opening 36' in the disc 34' along with the tubular section 28' can be axially aligned with each borehole extending through the auxiliary anchor plate 13. The function of the tubular sections 28, 28' associated with the boreholes 27 in the auxiliary anchor plate 13 and with the boreholes 36 in the threading disc 34 is shown in detail in FIGS. 9 to 11, and particularly in FIG. 10 which is the detail X in FIG. 2 on an enlarged scale.

The annular wedges 25 used in accordance with the invention for anchoring the tension members 4, are made up of three wedge sections 25*a* 25*b* and 25*c* resiliently secured together by a spring ring 42 inserted into an annular groove 41 extending around the outside of the wedge sections. Each of the wedge sections 25*a*, 25*b* and 25*c* have teeth 43 formed on the inside surface. Before threading a strand or tension element 4 through the threading tube 40, an annular wedge 25 is placed on the tubular section 28' aligned with the opening 36 in the disc 34 and such placement is effected by slightly spreading the wedge which can be equally accomplished, for example, with the use of a mandrel acting against the resistance of the spring ring 42. FIG. 11 shows the annular wedge 25 in the spread condition and in contact with the outside surface of the tubular section 28'. With the wedge fitted around the outside of the tubular section 28' there is no contact between the wedge and the tension element 4 as it extends through the tubular section. Accordingly the tension element 4 can be pushed through the opening 36 and the tubular section 28' without the teeth 43 on the inside surface of the wedge 25 coming into contact with the surface of the tension element. To meet the exact tolerances required in this region of the apparatus, it is preferable if the tubular section 28' is formed of a section of precision steel tube. After the strand or tension element 4 has reached its final position, the wedge 25 is displaced axially from the tubular section 28' and moved along the tension element 4 into the seat formed by the conically shaped section in one of the boreholes 27 of the auxiliary anchor plate 13. This function as described with the aid of FIG. 10 for the threading disc 34 with reference to the auxiliary anchor plate 13 is also true for the auxiliary anchor plate 13 with reference to the main anchor disc 11.

The assembly of a diagonal cable according to the invention is explained with reference to FIG. 2. After anchor tube 9 is inserted into the tube 7 extending inwardly from the abutment plate 8, the main anchor disc 11 along with the spacer 26 connected to it is attached onto the outer end 9*c* of anchor tube 9. Support arrangement 12 is placed around the anchor with the support arrangement 30 for the threading disc 34 secured to the support arrangement 12. Guide ring 44 encircling the part 9*b* of the anchor tube 9 adjacent the flange-like section 10 serves as a guide for the support arrangement about the anchor tube. Support arrangement 12 is secured by means of the brackets 16 by screwing the nuts 18 onto the bolts 17 which are threaded into the abutment plate 8. In this operation, the hydraulic presses 15 are displaced outwardly somewhat. Next, the main anchor plate 11 is fastened to the holding device 19 which is displaced along with the main anchor disc outwardly from the end 9*c* of the anchor pipe 9 into the position shown, in FIG. 2. In this position the holding device 19 is held by means of the bolts 23.

Next, the threading tube 40 is connected by the coupling 39 to the threading disc 34. An annular wedge 25 is slipped on each of the tubular sections 28' on the threading disc 34 and on each of the tubular sections 28 on the auxiliary anchor plate 13 with each tubular section 28 being arranged to align with a corresponding borehole 27 in the auxiliary anchor plate. With this arrangement effected, a tension element 4 can be threaded through the threading tube 40, the threading disc 34, the auxiliary anchor plate 13 and the anchor disc 11 including the spacer 26. In this operation the tension element or strand 4 is unwound from a large drum.

After the strand exits from the borehole in the spacer 26, an approximately oval shaped threading tip 51 is attached to the leading end of the strand and is secured by a cotter or linch pin note FIGS. 2*a* and 2*b*. The purpose of the threading tip 51 is to hold the individual wires of the strand 4 at the leading end and also to clear a path for the strand through the tubular sheathing 5 through which it is pushed toward the other anchor. Obstructions in the bundle are prevented due to the corresponding shape of the threading tip and the selection of its diameter.

As soon as the strand or tension element has passed from the anchor A and arrives in the anchor B, the wedge 25 mounted on the tubular section 28' of the threading disc 34 is displaced toward the auxiliary anchor plate 13. This arrangement is indicated by the uppermost strands shown in FIG. 2. As a result, the inserted tension element 4 can be fixed in place so that, when it is cut off between the auxiliary anchor plate 13 and the threading disc 34 there is no longer any risk that it will slip through the anchor.

Figure 3:
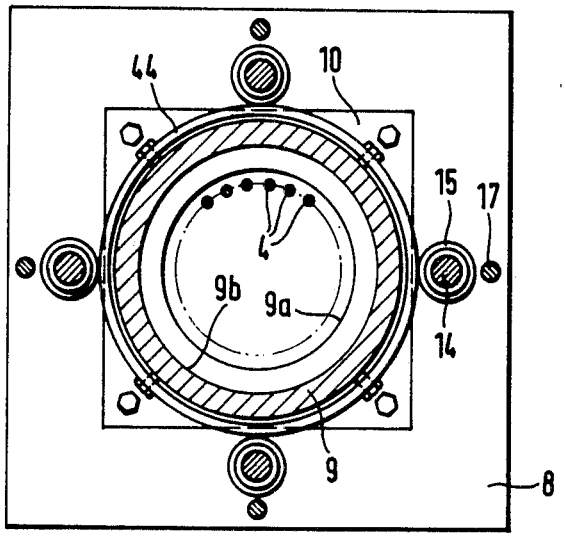
FIG. 3 is a sectional view taken along the line III—III in FIG. 2.
Figure 13:
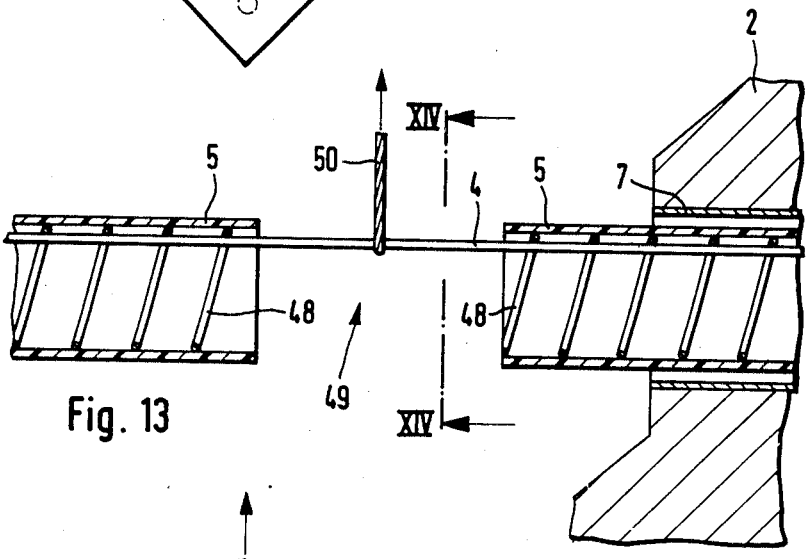
FIG. 13 is a sectional view on an enlarged scale of detail XIII in FIG. 1.
Figure 14:
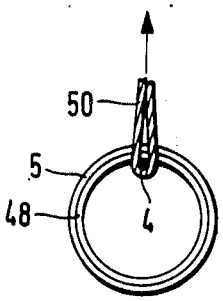
FIG. 14 is a sectional view taken along line XIV—XIV in FIG. 13.

In this manner some of the upper strands or tension elements 4 are first inserted and tensioned, as shown in FIG. 3. At the point where the diagonal cable emerges from the bridge part or tower 2, the tension elements 4 are lifted upwardly by a cable sling 50 to prevent sagging and to bring the sheathing tube 5 in the unsupported region into the desired position. As shown in FIGS. 13 and 14 the lifting of the upper tension elements 4 is effected in the region of an assembly opening or window 49. With this arrangement it is particularly simple to fix the sheathing tube 5 and to keep the cross-section of the sheathing tube open for inserting the remainder of the tension elements. The required spacing of the tension elements 4 relative to the inside wall of the tubular sheathing 5 is ensured by an inserted spiral 48 of steel wire.

Next, the assembly of the tension tie member continues starting with the tension elements at the bottom of the transverse cross-section and moving in the upward direction across the cross-section. The individual strands 4 are located closely above one another during this assembly operation so that sufficient room remains for inserting the upper tension elements. The tension elements in the upper half of the cross-section are only stretched, since they must remain slack whereby the tube cross-section is not constricted.

After all of the tension members or strands 4 are inserted and anchored in the intermediate anchoring plate 13 in this manner, the holding device 19 for the anchor plate 11 is released and the anchor plate can be displaced along the tension member into its final position seated against the end 9*c* of the anchor tube 9, note FIG. 8. The wedges 25 located on the tubular sections 28 on the auxiliary anchoring plate 13 are displaced along the tension elements 4 into the corresponding boreholes 24 in the main anchor plate 11 using the wedge disc 29 and possibly pressing the wedges into the boreholes. When this operation has been completed, the load can be removed from the auxiliary anchoring plate 13 and transferred to the main anchor plate 11 by relieving the hydraulic presses 15. The wedges in the auxiliary anchoring plate then become automatically loosened. Finally, the tension elements 4 can be brought to the final tensioned state either individually or as a group. Before grouting the space within the tubular sheathing and within the anchor tube 9 about the tension members 4, the assembly opening 49 must be placed in the closed position, such as by sliding a tubular member over it. The assembly of the opposite anchor can be completed in a similar manner, however, it is possible to dispense with the support arrangement 30 and the threading disc 34.

It should be obvious, in view of the above description of the threading disc 34, that the auxiliary anchor plate 13 and the auxiliary anchoring of the tension elements or strands 4 is required only if the main anchor plate cannot occupy its final position during the threading of the strands, as shown in FIG. 2. In the assembly arrangement described, it is necessary to attach the threading tip 51 on the leading end of the tension elements after they have passed through the main anchor plate. When such an arrangement is not required, or if it can be effected in another manner, it is possible to employ the threading disc 34 independently of the intermediate anchoring plate 13.

While specific embodiments of the invention have been shown and described in detail to illustrate the application of the inventive principles, it will be understood that the invention may be embodied otherwise without departing from such principles.

We claim:

1. Apparatus for assembling an axially elongated cable or tie member made up of individual axially elongated elements each having opposite ends, such as steel wires, strands or the like, a tubular sheathing laterally enclosing the elements, and a first anchor plate and a second anchor plate each arranged for anchoring the opposite ends of said elements with said tubular sheathing extending between said first and second anchor plates, in assembling the tie member the elements are inserted, in turn, through the first anchor plate having conically shaped boreholes therethrough, then through said tubular sheathing and through conically shaped boreholes in the second anchor plate, and multi-part annular wedges for insertion into the conically shaped boreholes for anchoring the elements in at least the first anchor plate, wherein the improvement comprises at least one auxiliary plate spaced in the axial direction of said tie member from the first anchor plate on the opposite side thereof from the second anchor plate, means for maintaining said auxiliary plate in spaced relation from the first anchor plate in the axial direction of the tie member, said auxiliary plate having at least one borehole extending therethrough in the axial direction of the tie member and said at least one borehole in said auxiliary plate being axially alignable with at least one of the boreholes in the first anchor plate, a first tubular section secured to the side of said auxiliary plate facing toward said first anchor plate and forming an extension of said at least one borehole through said auxiliary plate, said first tubular section having an axially extending outside surface arranged to receive one said multi-part annular wedge in displaceable contact with the outside surface and the annular wedge being resiliently radially expanded on the outside surface of said first tubular section.

2. Apparatus, as set forth in claim 1, wherein said auxiliary plate has a disc mounted therein for rotation about the axis of the tension tie member and said at least one borehole in said auxiliary plate being located within and extending through said disc.

3. Apparatus, as set forth in claim 2, wherein said first anchor plate has the boreholes extending therethrough arranged in a number of concentric circles, and said disc in said auxiliary plate having at least one borehole therethrough for each concentric circle of boreholes in said first anchor plate.

4. Apparatus, as set forth in claim 2, wherein said disc is located in said auxiliary plate eccentric to the axis of the tension tie member.

5. Apparatus, as set forth in claim 2. further comprising a bearing plate including a threading disc and a second tubular section spaced from said auxiliary plate on the opposite side of said first anchor plate wherein a connecting tube is secured to said threading disc on the opposite side thereof from said second tubular section and said connecting tube forms a continuation of the borehole through said auxiliary plate, and coupling means for connecting a threading tube to said connecting tube.

6. Apparatus, as set forth in claim 1, wherein said auxiliary plate is an auxiliary anchor plate and has a plurality of boreholes therethrough arranged to correspond to said boreholes in said first anchor plate, said boreholes in said auxiliary anchor plate being conically shaped for the intermediate anchoring of the individual tension elements by means of annular wedges, an abutment plate spaced in the axial direction of said tie member from said auxiliary anchor plate and secured on the surface of a structure to which the tie member is to be anchored and said means for maintaining said auxiliary plate in spaced relation from said first anchor plate is supported on said abutment plate.

7. Apparatus, as set forth in claim 6, wherein said means for maintaining said auxiliary plate in spaced relation compises a plurality of supports extending in the axial direction of the tie member and spaced laterally around the outer circumferential periphery of said auxiliary anchor plate.

8. Apparatus, as set forth in claim 7, wherein a plate is provided with a number of boreholes therethrough corresponding to the boreholes through said auxiliary anchor plate, said plate being located adjacent said auxiliary anchor plate and between said auxiliary anchor plate and said first anchor plate, said plate being displaceable in the axial direction of said tension tie member between said auxiliary anchor plate and said first anchor plate.

9. Apparatus, as set forth in claim 7, wherein each said support includes a hydraulic press so that said support can be displaced toward and away from said abutment plate 10. Apparatus, as set forth in claim 9, wherein a holding device is mounted on said supports for securing said first anchor plate thereto.

11. Apparatus, as set forth in claim 10, wherein said holding device is movably displaceably supported on said supports for movement in the axial direction of the tension tie member and means for securing said holding device to said supports.

12. A method of assembling and installing an axially elongated tie member between spaced parts of a structure, the tie member being made up of a plurality of separate axially elongated elements in the form of steel wires or strands, a tubular sheathing laterally enclosing the tension elements, a pair of anchors spaced apart in the axial direction of the tie member and each anchor including an anchor plate for anchoring said tie member to a separate part of the structure, each anchor plate having boreholes therethrough for receiving one element in each borehole, each of the anchor plates having a final position where the tie member is fully tensioned and anchored to a different part of the structure, and annular wedges engageable within said boreholes for anchoring the elements into the boreholes, comprising the steps of positioning at least one of the anchor plates in spaced relation from the final position thereof in the direction away from the other anchor plate, positioning an auxiliary anchor plate in spaced relation with one of the anchor plates and on the opposite side of the one of the anchor plates from the other anchor plate, inserting the elements individually first through the auxiliary anchor plate and then through the one of the anchor plates toward the other anchor plate passing through the tubular sheathing and finally through the other anchor plate, at least partially tensioning and anchoring the inserted elements in the auxiliary anchor plate, upon inserting all of the elements between the anchor plates moving the one of the anchor plates in the direction away from the auxiliary anchor plate into the final position thereof, and anchoring the elements into the one of the anchor plates and transferring the tension load on the elements from the auxiliary anchor plate to the one of the anchor plates.

13. A method, as set forth in claim 12, wherein the tie member is inclined to the horizontal between the anchor plates, the tubular sheathing having a cross-section therein extending transversely of the tie member including an uppermost portion, a lowermost portion and an intermediate portion therebetween, after positioning and fixing the tubular sheathing, initially inserting several elements in the uppermost portion of the cross-section of the tubular sheathing and tensioning and anchoring the inserted elements, and then inserting the remaining elements commencing in the lowermost portion of the cross-section of the tubular sheathing and continuously inserting the tension elements from the lowermost portion upwardly through the intermediate portion of the cross-section to the uppermost portion of the tubular sheathing cross-section.

14. A method, as set forth in claim 13, including the step of affording access through the tubular sheathing to the elements first inserted therethrough in the uppermost portion of the cross-section thereof, and supporting and lifting the first inserted elements.

15. Apparatus for assembling an axially elongated cable or tie member made up of individual axially elongates elements each having opposite ends, such as steel wires, strands or the like, a tubular sheathing laterally enclosing the elements, and a first anchor plate and a second anchor plate each arranged for anchoring one of the opposite ends of said elements with said tubular sheathing extending between said first and second anchor plates, in assembling the tie member the elements are inserted, in turn, through the first anchor plate having conically shaped boreholes therethrough, then through said tubular sheathing and through conically shaped boreholes in the second anchor plate, and multi-part annular wedges for insertion into the conically shaped boreholes for anchoring the elements in at least the first anchor plate, wherein the improvement comprises at least one auxiliary anchor plate spaced in the axial direction of said tie member from the first anchor plate on the opposite side thereof from the second anchor plate, means for maintaining said auxiliary anchor plate in spaced relation from the first anchor plate in the axial direction of the tie member, said auxiliary anchor plate having boreholes extending therethrough in the axial direction of the tie member and the boreholes in said auxiliary anchor plate being axially alignable with the boreholes in the first anchor plate, a tubular section for each borehole in said auxiliary anchor plate secured to the side of said auxiliary anchor plate facing toward said first anchor plate and forming an extension of the associated borehole through said auxiliary anchor plate, said tubular section having an axially extending outside surface arranged to receive one said multi-part annular wedge in displaceable contact with the outside surface and the annular wedge being resiliently radially expanded on the outside surface of said tubular section.

16. Apparatus, as set forth in claim 15, wherein an abutment plate is spaced in the axial direction of said tie member from said auxiliary anchor plate and is secured on the surface of the structure to which the tie member is to be anchored, and said means for maintaining said auxiliary anchor plate in spaced relation from said first anchor plate is supported on said abutment plate.

17. Apparatus, as set forth in claim 16, wherein said means for maintaining said auxiliary anchor plate in spaced relation comprises a plurality of supports extending in the axial direction of the tie member and spaced laterally around the outer circumferential periphery of said auxiliary anchor plate.

18. Apparatus, as set forth in claim 17, wherein a plate is provided with a number of boreholes therethrough corresponding to the boreholes through said auxiliary anchor plate, said plate being located adjacent said auxiliary anchor plate and between said auxiliary anchor plate and said first anchor plate, said plate being displaceable in the axial direction of said tension tie member between said auxiliary anchor plate and said first anchor plate.

* * * * *